United States Patent [19]

De Long

[11] 4,027,779

[45] June 7, 1977

[54] SERVING CONTAINER FOR HOT LIQUIDS

[76] Inventor: Carol De Long, 5938 Cahuenga, North Hollywood, Calif. 91601

[22] Filed: Aug. 11, 1975

[21] Appl. No.: 563,177

[52] U.S. Cl. ..... 220/23.83; 206/501

[51] Int. Cl.[2] ..... A47G 19/22; B65D 21/02

[58] Field of Search ..... 220/23.83, 23.86, 4 A, 220/4 C, 4 D; 206/501, 502

[56] References Cited

UNITED STATES PATENTS

| | | | |
|---|---|---|---|
| 162,921 | 5/1975 | Heston | 220/4 A |
| 328,240 | 10/1885 | Maylor | 220/4 A |
| 2,080,283 | 5/1937 | Lowenfels | 206/501 |
| 2,604,976 | 7/1952 | Sarg | 220/23 |
| 2,750,769 | 6/1956 | Yost | 220/69 |
| 2,766,796 | 10/1956 | Tupper | 220/23 |
| 3,257,024 | 6/1966 | Semanchik | 220/23.83 |
| 3,749,278 | 7/1973 | Von Bock-balhau | 206/501 |
| D47,573 | 7/1915 | Sanford | D7/3 |

*Primary Examiner*—George E. Lowrance
*Attorney, Agent, or Firm*—Jack C. Munro

[57] ABSTRACT

A container to facilitate the serving of hot liquids comprising a first container member and a second container member, the said second container member being divided into a first compartment and a second compartment with these compartments being separated by a common wall, the second container adapted to removably interlock with the first container.

1 Claim, 4 Drawing Figures

SERVING CONTAINER FOR HOT LIQUIDS

BACKGROUND OF THE INVENTION

The structure of this invention is designed to be particularly employed in the serving of hot tea. However, the structure of this invention could be employed to serve other hot liquids, such as coffee, soup or any other similar type of hot liquid.

In the serving of a cup of tea within a restaurant, the serving person would require a teapot, a cup, and some type of a plate such as a saucer in order to transport the teabag and a lemon wedge to the customer. Because of the number of pieces which have to be served to the customer, the serving person has to make a single separate trip to the customer to just serve the customer hot tea. The serving person can, in no way, carry any other piece or item also along to the customer.

Additionally, the different number of pieces which are conventionally employed to serve hot tea to a customer, will take up quite a bit of room on the customer's table.

The structure of this invention is bound to be of a particular advantage in restaurants, and it is considered to be within the scope of this invention to use the structure of this invention in other than restaurants, such as in the home or office.

SUMMARY OF THE INVENTION

The structure of this invention is believed to be summarily described in the Abstract Of The Disclosure and reference is to be had thereto.

The advantages of this invention are many and are as follows: Hot tea can be served to a single customer within a single connected unit and easily held in one hand by a serving person. The number of pieces is reduced, thereby reducing manufacturing costs. The structure of this invention completely eliminates the need and expense of a teapot and its associated spout which is conventionally used to serve the hot water. The unit of this invention occupies very little space when placed on a table. The number of serving pieces that have to be washed is also reduced. Since there is a lid or cover employed with the structure of this invention, one can place the lid upon the cup and thereby keep the contents of the cup hotter for a greater length of time.

The structure of this invention can also be used as an ash tray, if desired. The structure of this invention also serves as a warming device for the lemon wedge when the hot tea is steeping and it is well known that when lemon is warmed from its usual refrigerated temperature, the flavor and aroma is accentuated. Manufacturing costs for the structure of this invention is greatly reduced by there being less pieces and due to the simplicity of the design of the pieces.

DETAILED DESCRIPTION OF THE SHOWN EMBODIMENT

Figure 1:
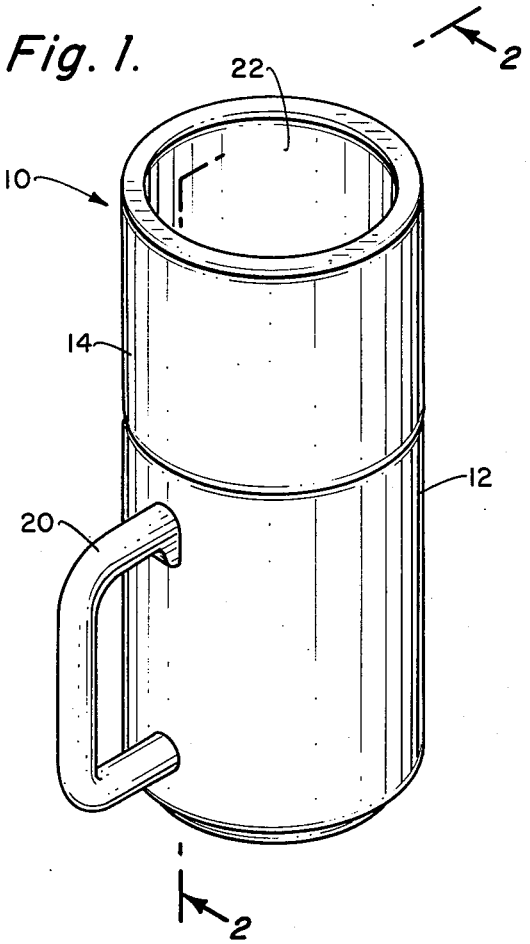
FIG. 1 is an isometric view of the steeping liquid container of this invention.

Referring particularly to the drawing, there is shown in FIG. 1, the steeping liquid container 10 of this invention which is composed of a first container, or a cup 12 and a second container or a lid 14. The cup 12 is deemed to be a conventional cup made from a ceramic or plastic material or other similar type of material and includes the use of an inner hot liquid receiving container 16, a base 18 and a handle 20 attached to the exterior wall of the cup 12.

The lid or second container 14 includes an upper or first compartment 22 and a lower or second compartment 24. The compartments 22 and 24 are separated by a common wall 26. It is to be noted that the overall configuration of the container 14 is basically circular in cross-section as is the same is true for the cup 12. However, it is considered to be within the scope of this invention that other basic cross-sectional shapes could be employed without departing from the scope of this invention.

The wall of the second container 14 in the area of the second compartment 24 is inset in order to form a depending annular flange 28 and an annular shoulder 30. The second container is to be placed on the first container 12 in an interlocked or nestled manner so that the second container 14 operates as a lid with respect to the cup 12. When the second container is so placed upon the first container 12, the flange 28 extends within the confines of the chamber 16 and the annular shoulder 30 rests upon the lip 32 of the cup 16. When the second container 14 is placed upon the first container 12, the container 16 is then closed to the ambient by means of the side walls of the first compartment 24 and the common wall 26. It is to be understood that the second container 14 is to be made of a similar type of material that is used to construct the cup 12.

Figure 2:
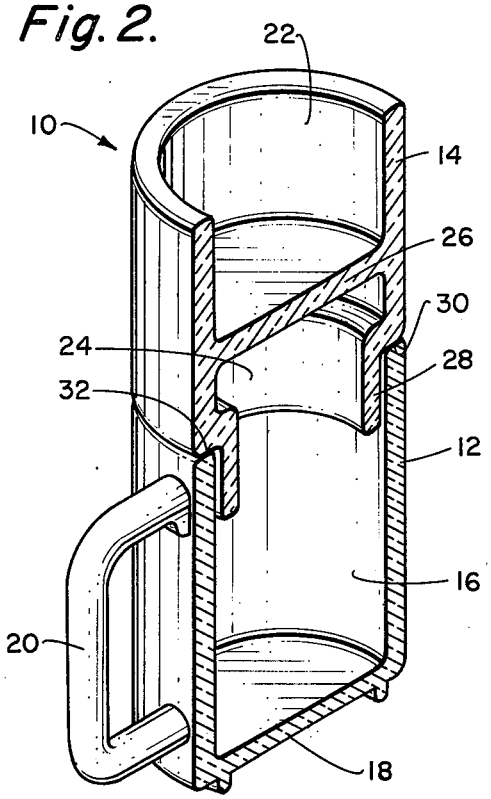
FIG. 2 is a cross-sectional view taken along line 2—2 of FIG. 1.
Figure 3:
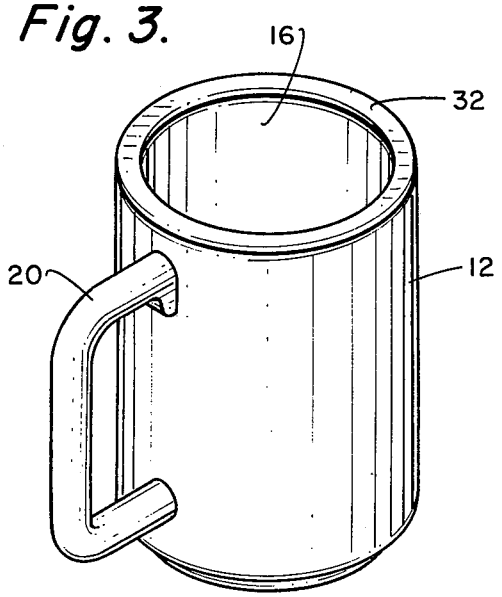
FIG. 3 is an isometric view of the cup or first container of this invention.

The use of the structure of this invention is as follows: It will be assumed that the device is being used in a restaurant by a serving person. The serving person places hot liquid within the chamber 16 of the cup 12. The serving person will then place within the first compartment 22 a lemon wedge and a teabag (both not shown and the lemon wedge may be eliminated, if desired). The second container is then placed upon the first container 12 as shown in FIGS. 1 and 2 of the drawing. The serving person then carries, by the handle 20 the entire unit to the customer and places such on the table in front of the customer. The customer then removes the second container from the cup 12 and places the teabag within the hot liquid contained within chamber 16. The customer would then replace the second container 14 upon the cup 12 thereby giving the teabag a chance to steep within the liquid. Because the lemon wedge rests against the common wall 26 and the common wall 26 receiving heat from the steeping liquid within the chamber 16, the lemon wedge will become warmed.

After a certain period of time, the customer will then remove the second container 14 from the cup 12 and then remove the lemon wedge from the first compartment 22. The person then reverses or inverts the second container 14 and places such on the table beside the cup 12. It is to be noted that the second container 24 would contain moisture droplets and by inverting the second container 14, the portion of the container which contacts the table does not contain any moisture thereon.

The customer then would squeeze the lemon wedge and then discard the used lemon wedge into the second compartment 24. Also, the teabag, when it has finished steeping, is placed within the second compartment 24.

Figure 4:
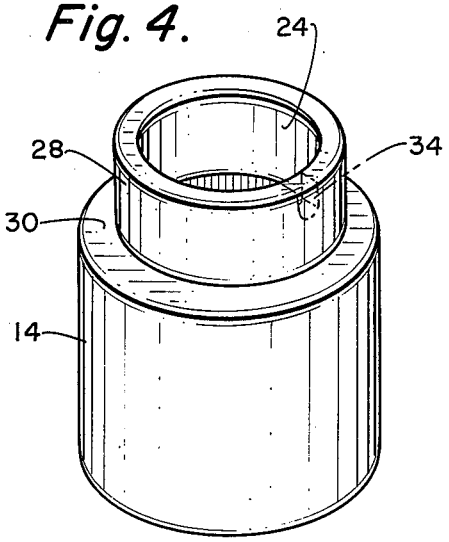
FIG. 4 is a inverted view of the second container or lid of the unit of this invention.

It may be found to use the second compartment 24 as an ash tray for a cigarette. For the second container 14 to accommodate such use, a cigarette receiving recess 34 may be included within the wall of the second compartment 24 such as is shown in FIG. 4. This is considered to merely be an optional feature.

As an alternative, the second container 24 could be formed with the second compartment eliminated and the common wall would then be the bottom of container 24. As a further alternative, the compartment 24 could be formed quite shallow.

As a still further embodiment, the compartment 24 could have a constant cross-sectional area which may be preferred for health reasons. Also, the side wall of compartment 24 could be inclined resembling a cone shape.

A still further modification would be to include a pouring spout on container 14 connecting with the first compartment 22. The spout would be useful if a liquid, such as cream, was contained within compartment 22.

What is claimed is:

1. A serving container comprising:

a first container having a single access opening therein, said access opening providing an access into a liquid retaining chamber, said first container having a lip surrounding said access opening, said first container including a handle;

a second container having a first compartment and a second compartment, a common wall separating said first compartment and said second compartment, said first and second compartments being substantially equal in volume with their volume being approximately one-half of said liquid retaining chamber of said first container, said common wall being integral with said second container; and means connected to the wall of said second container in the area of said second compartment for interconnecting with said first container, whereby said second container is adapted to be placed upon said first container with said means interlocking said second container with said first container to form a single unit, said means comprises an annular flange and an annular shoulder, with said second container placed upon said first container said annular flange extending within the confines of said first container and said annular shoulder resting upon the lip of said first container, with said second container placed upon said first container said first compartment being capable of containing a tea bag as well as other items while said common wall essentially closes said access opening of said first container, thereupon said second container may be removed from said first container after removal of the contents from said first compartment and said second container be inverted and placed upon a planar supporting surface with the said second compartment being capable of containing items such as the used tea bag.

* * * * *